US011112148B2

(12) United States Patent
Nieforth et al.

(10) Patent No.: US 11,112,148 B2
(45) **Date of Patent: *Sep. 7, 2021**

(54) VAPOR COMPRESSION SYSTEM WITH REFRIGERANT-LUBRICATED COMPRESSOR

(71) Applicant: Carrier Corporation, Palm Beach Gardens, FL (US)

(72) Inventors: Scott A. Nieforth, Clay, NY (US); Vishnu M. Sishtla, Manlius, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 58 days.

This patent is subject to a terminal disclaimer.

(21) Appl. No.: 16/320,802

(22) PCT Filed: Aug. 10, 2017

(86) PCT No.: PCT/US2017/046241

§ 371 (c)(1),
(2) Date: Jan. 25, 2019

(87) PCT Pub. No.: WO2018/038926

PCT Pub. Date: Mar. 1, 2018

(65) Prior Publication Data

US 2019/0178537 A1 Jun. 13, 2019

Related U.S. Application Data

(60) Provisional application No. 62/379,991, filed on Aug. 26, 2016.

(51) Int. Cl.
*F25B 31/00* (2006.01)
*F25B 41/20* (2021.01)

(52) U.S. Cl.
CPC ..... *F25B 31/004* (2013.01); *F25B 31/002* (2013.01); *F25B 41/20* (2021.01);
(Continued)

(58) Field of Classification Search
CPC ..... F25B 31/002; F25B 31/004; F25B 1/053; F25B 43/02; F25B 2339/0242;
(Continued)

(56) References Cited

U.S. PATENT DOCUMENTS 5,469,713 A 11/1995 Wardle et al.
6,065,297 A 5/2000 Tischer et al.
(Continued)

FOREIGN PATENT DOCUMENTS

CN 1322289 A 11/2001
CN 101970953 A 2/2011
(Continued)

OTHER PUBLICATIONS

European Office action dated Apr. 9, 2020 for European Patent Application No. 17754961.5.
(Continued)

*Primary Examiner* — Joseph F Trpisovsky
(74) *Attorney, Agent, or Firm* — Bachman & LaPointe, P.C.

(57) ABSTRACT

A vapor compression system (20; 400; 420) comprises: a compressor (22) having a suction port (40) and a discharge port (42); a heat rejection heat exchanger (58) coupled to the discharge port to receive compressed refrigerant; a heat absorption heat exchanger (88); a first lubricant flowpath (120, 126) from the heat rejection heat exchanger to the compressor; a second lubricant flowpath (121, 126) from the heat absorption heat exchanger to the compressor; at least one lubricant pump (190); and a controller (900) configured to control lubricant flow along the first lubricant flowpath and the second lubricant flowpath based on a sensed fluctuation.

20 Claims, 10 Drawing Sheets

(52) U.S. Cl.
CPC ..... *F25B 2339/0242* (2013.01); *F25B 2339/047* (2013.01); *F25B 2500/16* (2013.01); *F25B 2700/04* (2013.01); *F25B 2700/151* (2013.01)

(58) Field of Classification Search
CPC ..... F25B 2339/047; F25B 2500/16; F25B 2700/03; F25B 2700/04; F04D 25/06; F04D 29/063; F04D 29/4213
See application file for complete search history.

(56) References Cited

U.S. PATENT DOCUMENTS

| | | | | |
|---|---|---|---|---|
| 6,134,911 | A | 10/2000 | Kishimoto et al. | |
| 6,176,092 | B1 * | 1/2001 | Butterworth | F04D 29/023 62/193 |
| 6,266,964 | B1 * | 7/2001 | Meyer | F04B 39/0207 137/392 |
| 6,526,765 | B2 | 3/2003 | Lifson | |
| 6,564,560 | B2 | 5/2003 | Butterworth et al. | |
| 7,216,494 | B2 | 5/2007 | Thurman | |
| 8,104,298 | B2 | 1/2012 | Sishtla | |
| 2010/0196170 | A1 * | 8/2010 | Chen | F04B 39/0207 417/228 |
| 2013/0014537 | A1 | 1/2013 | Fujisawa et al. | |
| 2014/0360210 | A1 | 12/2014 | Lapp et al. | |
| 2015/0362233 | A1 | 12/2015 | Jandal et al. | |
| 2015/0362260 | A1 | 12/2015 | Smith et al. | |
| 2016/0010691 | A1 | 1/2016 | Lapp et al. | |
| 2016/0040915 | A1 | 2/2016 | Jonsson et al. | |
| 2016/0047575 | A1 | 2/2016 | Jonsson et al. | |
| 2018/0180333 | A1 | 6/2018 | Sishtla et al. | |

FOREIGN PATENT DOCUMENTS

| | | | |
|---|---|---|---|
| CN | 102713463 | A | 10/2012 |
| WO | 00/22359 | A1 | 4/2000 |
| WO | 2014/117012 | A1 | 7/2014 |
| WO | 2014/158329 | A1 | 10/2014 |
| WO | 2014/179032 | A1 | 11/2014 |
| WO | 2015/142825 | A1 | 9/2015 |
| WO | 2018/038918 | A1 | 3/2018 |

OTHER PUBLICATIONS

David C. Brondum et al., "High-Speed, Direct-Drive Centrifugal Compressors for Commercial HVAC Systems," presented at the 1998 International Compressor Conference at Purdue, 1998.

D.R. Pandy et al., "Innovative, Small, High-Speed Centrifugal Compressor Technologies," presented at the 1996 International Compressor Engineering conference at Purdue, Jul. 1996.

V.M. Sishtla, "Design and Testing of an Oil-Free Centrifugal Water-Cooled Chiller", International Conference on Compressors and their Systems: Sep. 13-15, 1999, City University, London, UK, conference transactions, The Institution of Mechanical Engineers, 1999, pp. 505-521.

International Search Report and Written Opinion dated Oct. 25, 2017 for PCT Patent Application No. PCT/US2017/046241.

International Search Report and Written Opinion dated Oct. 30, 2017 for PCT Patent Application No. PCT/US2017/046052.

Extended European Search Report dated Jan. 28, 2020 for European Patent Application No. 19201796.0.

Chinese Office Action dated Jul. 27, 2020 for Chinese Patent Application No. 201780052391.3.

European Office Action dated Sep. 15, 2020 for European Patent Application No. 17754961.5.

* cited by examiner

VAPOR COMPRESSION SYSTEM WITH REFRIGERANT-LUBRICATED COMPRESSOR

CROSS-REFERENCE TO RELATED APPLICATION

Benefit is claimed of U.S. Patent Application No. 62/379,991, filed Aug. 26, 2016, and entitled "Vapor Compression System with Refrigerant-Lubricated Compressor", the disclosure of which is incorporated by reference herein in its entirety as if set forth at length.

BACKGROUND

The disclosure relates to compressor lubrication. More particularly, the disclosure relates to centrifugal compressor lubrication.

A typical centrifugal chiller operates with levels of lubricant at key locations in flowing refrigerant. The presence of an oil reservoir, typically with more than a kilogram of oil will cause an overall content of oil to exceed 1.0 percent by weight when the oil accumulation in the reservoir is added to the numerator and denominator of the fraction. The concentration will be relatively low in the condenser (e.g., 50 ppm to 500 ppm). At other locations, the concentrations will be higher. For example the oil sump may have 60+ percent oil. This oil-rich portion is used to lubricate bearings. Thus, flow to the bearings will typically be well over 50 percent oil. At one or more locations in the system, strainers, stills, or other means may be used to withdraw oil and return it to a reservoir. It is desirable to remove the oil from locations where it may interfere with heat transfer or other operations.

There has for a long time existed a desire to operate chiller compressors and other rotating machinery and pumps without the need for a dedicated oil system. David C. Brondum, D. C., James E. Materne, J. E., Biancardi, F. R., and Pandy, D. R., "High-Speed, Direct-Drive Centrifugal Compressors for Commercial HVAC Systems," presented at the 1998 International Compressor Conference at Purdue, 1998; Pandy, D. R. and Brondum, D., "Innovative, Small, High-Speed Centrifugal Compressor Technologies," presented at the 1996 International Compressor Engineering conference at Purdue, July, 1996; Sishtla, V. M., "Design and Testing of an Oil-Free Centrifugal Water-Cooled Chiller", International Conference on Compressors and their Systems: 13-15 Sep. 1999, City University, London, UK, conference transactions, The Institution of Mechanical Engineers, 1999, pp. 505-521. In these tests, ceramic balls were used as the rolling element.

Jandal et al., WO2014/117012 A1, published Jul. 31, 2014, discloses a refrigerant-lubricated compressor. With such compressors, it is important that relatively high quality (high liquid fraction) refrigerant be delivered to the bearings.

US Patent Application Publication 2015/0362233 A1, of Jandal et al., published Dec. 17, 2015, discloses a system that switches a lubricant/coolant pump between sourcing at the condenser and evaporator.

U.S. Patent Application No. 62/201,064, filed Aug. 4, 2015, and entitled "Liquid Sensing for Refrigerant-Lubricated Bearings", the disclosure of which is incorporated by reference herein in its entirety as if set forth at length, discloses a refrigerant-lubricated system that forms the basis of particular examples below.

SUMMARY

One aspect of the disclosure involves a vapor compression system comprising: a compressor having a suction port and a discharge port; a heat rejection heat exchanger coupled to the discharge port to receive compressed refrigerant; a heat absorption heat exchanger; and at least one lubricant pump. A first lubricant flowpath extends from the heat rejection heat exchanger to the compressor. A second lubricant flowpath extends from the heat absorption heat exchanger to the compressor. A controller is configured to control lubricant flow along the first lubricant flowpath and the second lubricant flowpath based on a sensed fluctuation.

In one or more embodiments of any of the foregoing embodiments, the at least one lubricant pump is shared by the first lubricant flowpath and the second lubricant flowpath and the system comprises a pressure sensor positioned to measure an outlet pressure of the at least one lubricant pump.

In one or more embodiments of any of the foregoing embodiments, the sensed fluctuation is a sensed fluctuation in an outlet pressure of the at least one lubricant pump.

In one or more embodiments of any of the foregoing embodiments, the at least one lubricant pump is shared by the first lubricant flowpath and the second lubricant flowpath and the system comprises a vibration sensor positioned to measure a vibration of the at least one lubricant pump.

In one or more embodiments of any of the foregoing embodiments, the sensed fluctuation is a sensed vibration of the at least one lubricant pump.

In one or more embodiments of any of the foregoing embodiments, the compressor comprises an electric motor and the first lubricant flowpath and the second lubricant flowpath extend to bearings of the motor.

In one or more embodiments of any of the foregoing embodiments, one or more valves are controlled by the controller to selectively switch lubricant flow between the first lubricant flowpath and the second lubricant flowpath.

In one or more embodiments of any of the foregoing embodiments, the one or more valves comprise: a first valve controlled by the controller along the first lubricant flowpath; and a second valve controlled by the controller along the second lubricant flowpath.

In one or more embodiments of any of the foregoing embodiments, a method for using the system, comprises: running the at least one lubricant pump to drive a lubricant flow along one of the first lubricant flowpath and the second lubricant flowpath and not the other of the first lubricant flowpath and the second lubricant flowpath; and responsive to the controller sensing a threshold of said fluctuation, the controller switching to running the at least one lubricant pump to drive a lubricant flow along said other of the first lubricant flowpath and the second lubricant flowpath and not said one of the first lubricant flowpath and the second lubricant flowpath.

In one or more embodiments of any of the foregoing embodiments, the method further comprises, after having commenced the running of the at least one lubricant pump, commencing running the compressor to drive a flow of refrigerant sequentially through the heat rejection heat exchanger, the expansion device, and the heat absorption heat exchanger.

In one or more embodiments of any of the foregoing embodiments, the switching comprises controlling at least one valve while continuously running the at least one lubricant pump.

Another aspect of the disclosure involves a vapor compression system comprising: a compressor having a suction port and a discharge port; a heat rejection heat exchanger coupled to the discharge port to receive compressed refrigerant; a heat absorption heat exchanger; a first lubricant flowpath from the heat rejection heat exchanger to the compressor; a first pump along the first lubricant flowpath; a second lubricant flowpath from the heat absorption heat exchanger to the compressor; and a second pump along the second lubricant flowpath.

In one or more embodiments of any of the foregoing embodiments, a first liquid level switch is associated with the first pump and a second liquid level switch is associated with the second pump.

In one or more embodiments of any of the foregoing embodiments, a controller is configured to: responsive to the first liquid level switch indicating low, stop the first pump and start the second pump; and responsive to the second liquid level switch indicating low, stop the second pump and start the first pump.

In one or more embodiments of any of the foregoing embodiments, the first liquid level switch is upstream of the first pump; and the second liquid level switch is upstream of the second pump.

In one or more embodiments of any of the foregoing embodiments, the controller is configured to stop the first pump after starting the second pump and stop the second pump after starting the first pump.

In one or more embodiments of any of the foregoing embodiments, a method for using the system comprises: running the first pump to drive a lubricant flow along the first lubricant flowpath; and switching to running the second pump to drive a lubricant flow along the second lubricant flowpath.

In one or more embodiments of any of the foregoing embodiments, the method further comprises stopping the first pump after starting the second pump.

In one or more embodiments of any of the foregoing embodiments, the method further comprises, after having commenced the running of at least one of the first pump and the second pump, commencing running the compressor to drive a flow of refrigerant sequentially through the heat rejection heat exchanger, the expansion device, and the heat absorption heat exchanger.

In one or more embodiments of any of the foregoing embodiments, the system is a chiller.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
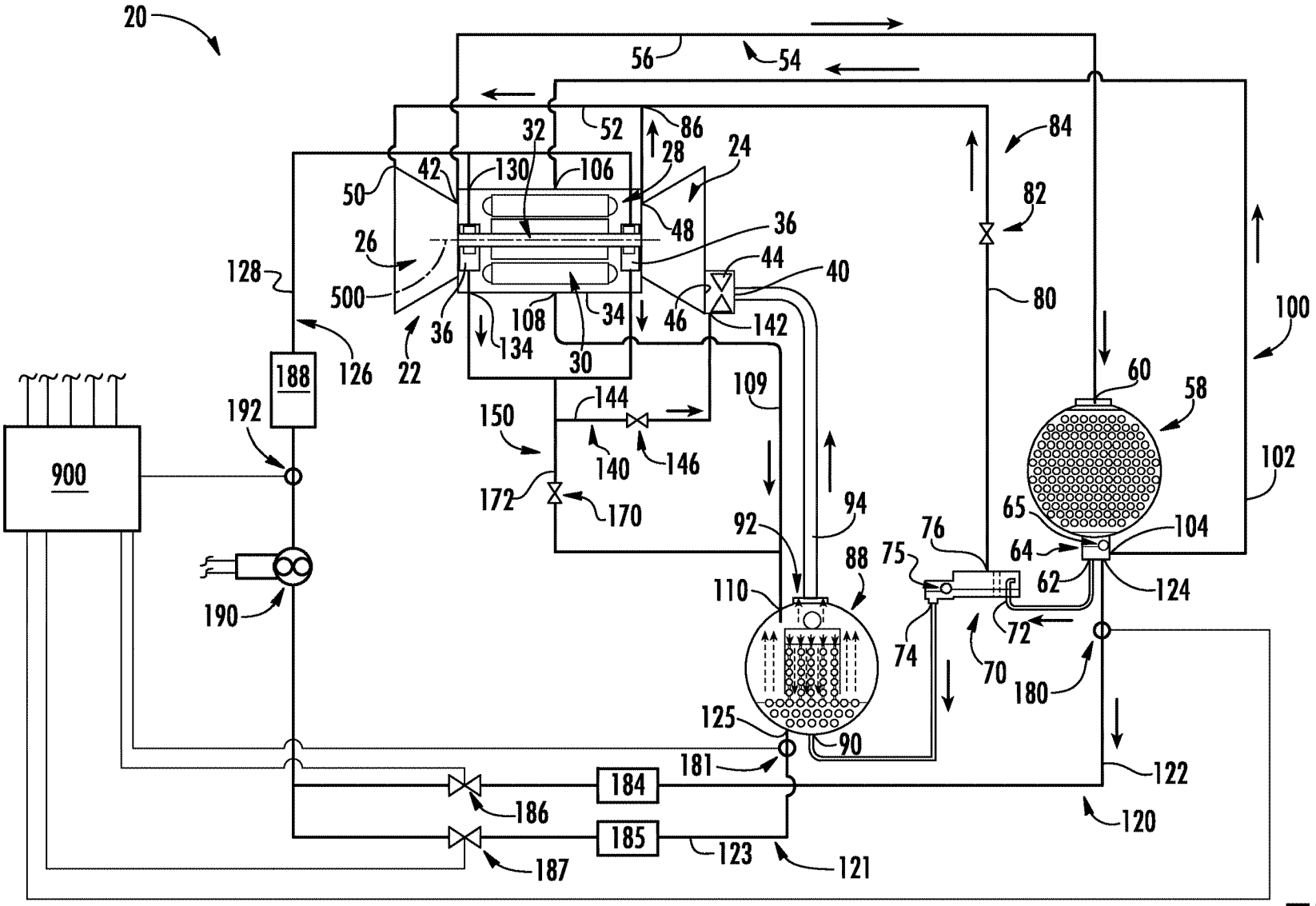
FIG. 1 is a schematic view of a vapor compression system in a first mode of operation.

FIG. 1 shows a vapor compression system 20. This reflects details of one particular baseline system. Other systems may be subject to similar modifications to add a liquid sensor or replace a baseline liquid sensor. FIG. 1 shows flow arrows (and thus associated valve conditions) associated with operating conditions that may correspond to a startup condition or, generally, a condition where there is a low pressure difference between condenser and evaporator. Other operating conditions are discussed further below. The exemplary system 20 is a chiller having a compressor 22 driving a recirculating flow of refrigerant. The exemplary compressor is a two-stage centrifugal compressor having a first stage 24 and a second stage 26. Impellers of the two stages are co-spooled and directly driven by an electric motor 28 having a stator 30 and a rotor 32. The compressor has a housing or case 34 supporting one or more bearings 36 to in turn support the rotor 32 for rotation about its central longitudinal axis 500 forming a central longitudinal axis of the compressor. As is discussed further below, the bearings are rolling element bearings with one or more circumferential arrays of rolling elements radially sandwiched between an inner race on the rotor (e.g., mounted to a shaft) and an outer race on the housing (e.g., press fit into a bearing compartment). Exemplary rolling elements include balls, straight rollers (e.g., including needles), and tapered rollers. Exemplary bearings are hybrid bearings with steel races and ceramic rolling elements. Exemplary ceramic rolling elements are silicon nitride ceramic balls. Exemplary races are 52100 bearing steel rings and high nitrogen CrMo martensitic steel rings, including Böhler N360 (trademark of BÖHLER Edelstahl GmbH & Co KG, Kapfenberg, Austria) and Cronidur 30 (trademark of Energietechnik Essen GmbH, Essen, Germany).

As is discussed further below, the exemplary vapor compression system 20 is an essentially oil or lubricant-free system. Accordingly, it omits various components of traditional oil systems such as dedicated oil pumps, oil separators, oil reservoirs, and the like. However, a very small amount of oil or other material that may typically be used as a lubricant may be included in the overall refrigerant charge to provide benefits that go well beyond the essentially non-existent amount of lubrication such material would be expected to provide. As is discussed further below, a small amount of material may react with bearing surfaces to form protective coatings. Accordingly, even though traditional oil-related components may be omitted, additional components may be present to provide refrigerant containing the small amounts of material to the bearings. In discussing this below, terms such as "oil-rich" may be used. Such terms are understood as used to designate conditions relative to other conditions within the present system. Thus, "oil-rich" as applied to a location in the FIG. 1 system may be regarded as extremely oil-depleted or oil-free in a traditional system.

The exemplary compressor has an overall inlet (inlet port or suction port) 40 and an overall outlet (outlet port or discharge port) 42. In the exemplary configuration, the outlet 42 is an outlet of the second stage 26. The inlet 40 is upstream of an inlet guide vane array 44 which is in turn upstream of the first stage inlet 46. The first stage outlet 48 is coupled to the second stage inlet 50 by an interstage line (interstage) 52. Although inlet guide vanes (IGVs) are shown only for the first stage, alternative implementations may additionally or alternatively have IGVs for the second stage. Another variation is a single stage compressor with inlet guide vanes.

As is discussed further below, additional flows of refrigerant may exit and/or enter the compressor at additional locations. From the discharge port 42, a main refrigerant flowpath 54 proceeds downstream in a normal operational mode along a discharge line 56 to a first heat exchanger 58. In the normal operational mode, the first heat exchanger is a heat rejection heat exchanger, namely a condenser. The exemplary condenser is a refrigerant-water heat exchanger wherein refrigerant passes over tubes of a tube bundle which carry a flow of water (or other liquid). The condenser 58 has one or more inlets and one or more outlets. An exemplary primary inlet is labeled 60. An exemplary primary outlet is labeled 62. An exemplary outlet 62 is an outlet of a sump 64 at the base of a vessel of the condenser 58. An outlet float valve assembly 65 may include an orifice at the outlet 62 to serve as an expansion device. Additional sump outlets are shown and discussed below.

The exemplary system 20 is an economized system having an economizer 70 downstream of the condenser along the flowpath 54. The exemplary economizer is a flash tank economizer having an inlet 72, a liquid outlet 74, and a vapor outlet 76. In the exemplary implementation, the vapor outlet 76 is connected to an economizer line 80 defining an economizer flowpath 84 as a branch off the main flowpath 54 returning to an economizer port 86 of the compressor which may be at the interstage (e.g., line 52). A control valve 82 (e.g., an on-off solenoid valve may be along the economizer line. An outlet float valve assembly 75 may include an orifice at the liquid outlet 74 to serve as an expansion device. The main flowpath 54 proceeds downstream from the economizer liquid outlet 74 to an inlet 90 of a second heat exchanger 88. The exemplary heat exchanger 88 is, in the normal operational mode, a heat absorption heat exchanger (e.g., evaporator). In the exemplary chiller implementation, the evaporator 88 or "cooler" is a refrigerant-water heat exchanger which may have a vessel and tube bundle construction wherein the tube bundle carries the water or other liquid being cooled in the normal operational mode. For simplicity of illustration, FIG. 1 omits details including the inlet and outlet for the flows of water or other heat transfer fluid for the heat exchangers. The evaporator has a main outlet 92 connected to a suction line 94 which completes the main flowpath 54 returning to the inlet 40.

Several additional optional flowpaths and associated conduits and other hardware are shown branching off from and returning to the main flowpath 54. In addition to the economizer flowpath 84, a motor cooling flowpath 100 also branches off from and returns to the flowpath 54. The exemplary motor cooling flowpath 100 includes a line 102 extending from an upstream end at a port 104 on some component along the main flowpath (shown as the sump 64). The line 102 extends to a cooling port 106 on the compressor. The motor cooling flowpath passes through the port 106 into a motor case of the compressor. In the motor case, the cooling flow cools the stator and rotor and then exits a drain port 108. Along the flowpath 100, a motor cooling return line 109 returns the flow from the port 108 to the main flowpath. In this example, it returns to a port 110 on the vessel of the evaporator 88.

A more complicated optional system of flowpaths may be associated with bearing cooling/lubrication. In various situations, it may be appropriate to draw bearing cooling/lubrication refrigerant from different locations in the system. For example, depending upon availability, refrigerant may be drawn from a first location such as the first heat exchanger 58 or a location associated therewith or a second location such as the second heat exchanger 88 or a location associated therewith. As is discussed further below, startup conditions may be particularly relevant. Depending upon initial temperatures, liquid refrigerant may be more readily available at one of the two locations relative to the other. A first leg 120 (first flowpath or first branch) of a bearing supply flowpath is formed by a line 122 extending from a port 124 located along the main flowpath (e.g., at the sump 64 of the heat exchanger 58). A second leg 121 of the bearing supply flowpath is formed by a line 123 extending from a port 125 on the heat exchanger 88. The two legs ultimately merge into a leg 126 formed by a line 128 and passing refrigerant to one or more ports 130 on the compressor communicating refrigerant to respective associated bearings 36.

One or more ports 134 extend from one or more drains at the bearings to return refrigerant to the main flowpath. In this embodiment, two possible return paths are shown. A first return path or branch 140 passes to a port 142 immediately downstream of the inlet guide vane array 44. This port 142 is at essentially the lowest pressure condition in the system and thus provides the maximum suction for drawing refrigerant through the bearings. A valve 146 may be along a line 144 along this flowpath branch. The exemplary valve 146 is an electronically controlled on-off valve (e.g., a solenoid valve) under control of a system controller. A second bearing return flowpath/branch 150 is discussed below.

As noted above, FIG. 1 also shows a second bearing drain flowpath branch 150. The exemplary flowpath branch 150 joins the line 109. A valve 170 (e.g., similar to 146) is located in a line 172 along the flowpath 150 to control flow. In an exemplary FIG. 1 condition, the valve 170 is closed blocking flow along the branch 150.

The flowpath legs 120 and 121 may each have several similar components. In the illustrated embodiment, they each have a liquid level sensor 180, 181 (e.g., liquid level switch) relatively upstream followed by a strainer 184, 185. Downstream of the strainers are respective controllable valves 186, 187. Exemplary valves 186, 187 are solenoid valves (e.g., normally-closed solenoid valves).

The exemplary legs 120, 121 join to form the leg 126. Along the leg 126 there may be a filter 188. A pump 190 is also located along the leg 126. Thus, the pump is shared by the legs 120, 121 and will drive flow along the associated leg 120, 121 if its respective valve 186, 187 is open. Exemplary pumps are positive displacement pumps (e.g., gear pumps) and centrifugal pumps. Operation of the valves 186, 187 may be responsive to one or more sensed parameters. FIG. 1 shows a pressure transducer 192 positioned at or downstream of the pump to measure a pump discharge pressure. An exemplary type of pressure transducer is a ceramic capacitive sensor-type transducer. The transducer 192 may be used by the controller 900 to sense pressure fluctuations (e.g., pump discharge pressure fluctuations). Pressure fluctuations will evidence that vapor is being drawn along whichever of the legs 120 and 121 is active. Thus, upon the controller determining a threshold pressure fluctuation, the controller may switch the inactive and active states of the legs 120, 121 by closing the formerly open valve 186, 187 and opening the formerly closed such valve. Absent a loss of refrigerant condition, if there is insufficient liquid refrigerant being drawn from one of the two locations, it is expected that there will be sufficient liquid refrigerant available at the other.

A particularly relevant situation is startup. The startup routine may be configured to provide refrigerant flow to the bearings 36 prior to starting the motor 28. Initially, the controller 900 may open one of the valves 186 and 187, turn on the pump 190, and then, if threshold vibration is detected, switch states of the valves 186, 187. The initially selected leg 120 or 121 may be based on several factors depending on implementation.

In other implementations, temperature and/or pressure sensors may be used by the controller to determine which of the legs 120 and 121 is likely to yield relatively vapor-free refrigerant.

A number of types and configurations of liquid level sensors 180, 181 exist. The exemplary sensor is an optical sensor as discussed below. The sensor has an operative/sensing end (e.g., a prism) positioned to be exposed to the liquid in a normal situation of sufficient liquid. In this example, the sensor is an optical sensor and the exposure is an optical exposure which may, however, also include physical exposure with the end contacting the fluid (liquid refrigerant and/or vapor). The sensor may be used to determine whether the liquid surface has descended below a critical level (whereafter further descent might risk vapor being ingested by the bearings). The determination of the surface descending to this threshold height may trigger a response by the controller 900. Exemplary responses may include compressor shutdown or may include some form of remedial activity.

The exemplary sensors 180, 181 are each a switch positioned to change state when the liquid level transits a certain threshold height relative to the prism. The exemplary liquid level switch is configured to have a closed condition associated with a sufficient liquid exposure (although an open condition version may alternatively be used). An exemplary threshold is approximately halfway up the prism.

FIG. 1 shows flow arrows associated with one operational mode, namely a startup mode. Yet other modes are possible and may be dependent upon other system details or modifications thereof (e.g., a defrost dehumidification mode where one heat exchanger is a refrigerant-air heat exchanger or possible other modes where the functions of the two heat exchangers become reversed).

The overall circulating refrigerant mixture may comprise: one or more base refrigerants or refrigerant bases (e.g., discussed below); optionally a small amount of an oil material that might normally be regarded as a lubricant; optionally, further additives; and contaminants, if any.

Exemplary base refrigerant can include one or more hydrofluoroolefins, hydrochloroolefins, and mixtures thereof (e.g., including hydrochloroflouroolefins). Below HFO is used to synonymously refer to all three of these refrigerant types. Exemplary hydrochloroflouroolefins include chloro-trifluoropropenes. Exemplary chloro-trifluoropropenes, arel-chloro-3,3,3-trifluoropropene and/or 2-chloro-3,3,3-trifluoropropene, and most particularly trans-1-chloro-3,3,3-trifluoropropene (E-HFO-1233zd, alternatively identified as R1233zd(E)). The hydrofluoroolefins can be a C3 hydrofluoroolefin containing at least one fluorine atom, at least one hydrogen atom and at least one alkene linkage. Exemplary hydrofluoroolefins include 3,3,3-trifluoropropene (HFO-1234zf), E-1,3,3,3-tetrafluoropropene, (E-HFO-1234ze), Z-1,3,3,3-tetrafluoropropene (Z-HFO-1234ze), 2,3,3,3-tetrafluoropropene (HFO-1234yf), E-1,2,3,3,3-pentafluoropropene (E-HFO-1255ye), Z-1,2,3,3,3-pentafluoropropene (Z-HFO-125ye).

Exemplary oils are polyol ester (POE) oils. Other possible oils include polyalkylene glycols (PAG), polyvinyl ethers (PVE), alkylbenzenes, polyalpha olefins, mineral oils, and the like as well as mixtures. A relevant consideration is the availability of hydrocarbons that can form an organic protective layer on the bearing surfaces.

The trace polyol ester oil (100 ppm) may particularly be of the hindered type excellent in thermal stability. The polyol ester oil is obtained from the condensation reaction between polyhydric alcohols and monohydric fatty acids (e.g., medium molecular weight ($C_5$-$C_{10}$)). Particular examples of polyhydric alcohols include neopentyl glycol, trimethylolethane, trimethylolpropane, trimethylolbutane, pentaerythritol, dipentaerythritol, and higher polyether oligomers of pentaerythritol, such as tripentaerythritol and tetrapentaerythritol. Polyol esters can be formed from monohydric fatty acids including n-pentanoic acid, n-hexanoic acid, n-heptanoic acid, n-octanoic acid, 2-methylbutanoicacid, 2-methylpentanoic acid, 2-methylhexanoic acid, 2-ethylhexanoic acid, isooctanoic acid, 3,5,5-trimethylhexanoic acid.

The additives may comprise a wide range of functionalities, including: extreme pressure agents; acid capturing agents; defoamers; surfactants; antioxidants; corrosion-inhibitors; plasticizers; metal deactivating agents. These may comprise a wide range of chemistries including: epoxides; unsaturated hydrocarbons or unsaturated halocarbons; phthalates; phenols; phosphates; perfluoropolyethers; thiols; phosphites; siloxanes; tolytriazoles; benzotriazoles; amines; zinc dithiophosphates; and amine/phosphate ester salts. Exemplary individual additive concentrations are no more than 1.0% by weight, more particularly 10 ppm to 5000 ppm or no more than 1000 ppm or no more than 200 ppm. Exemplary aggregate non-oil additive concentrations are no more than 5.0% by weight, more particularly, no more than 2.0% or no more than 1.0% or no more than 5000 ppm or no more than 1000 ppm or no more than 500 ppm or no more than 200 ppm or no more than 100 ppm.

FIG. 1 further shows a controller 900. The controller may receive user inputs from an input device (e.g., switches, keyboard, or the like) and sensors (not shown, e.g., pressure sensors, temperature sensors, and/or flow sensors (e.g. particularly measuring flow to the bearings) at various system locations). The controller may be coupled to the sensors and controllable system components (e.g., valves, the bearings, the compressor motor, vane actuators, and the like) via control lines (e.g., hardwired or wireless communication paths). The controller may include one or more: processors; memory and storage (e.g., for storing program information for execution by the processor to perform the operational methods and for storing data used or generated by the program(s)); and hardware interface devices (e.g., ports) for interfacing with input/output devices and controllable system components.

The system may be made using otherwise conventional or yet-developed materials and techniques.

Figure 7:
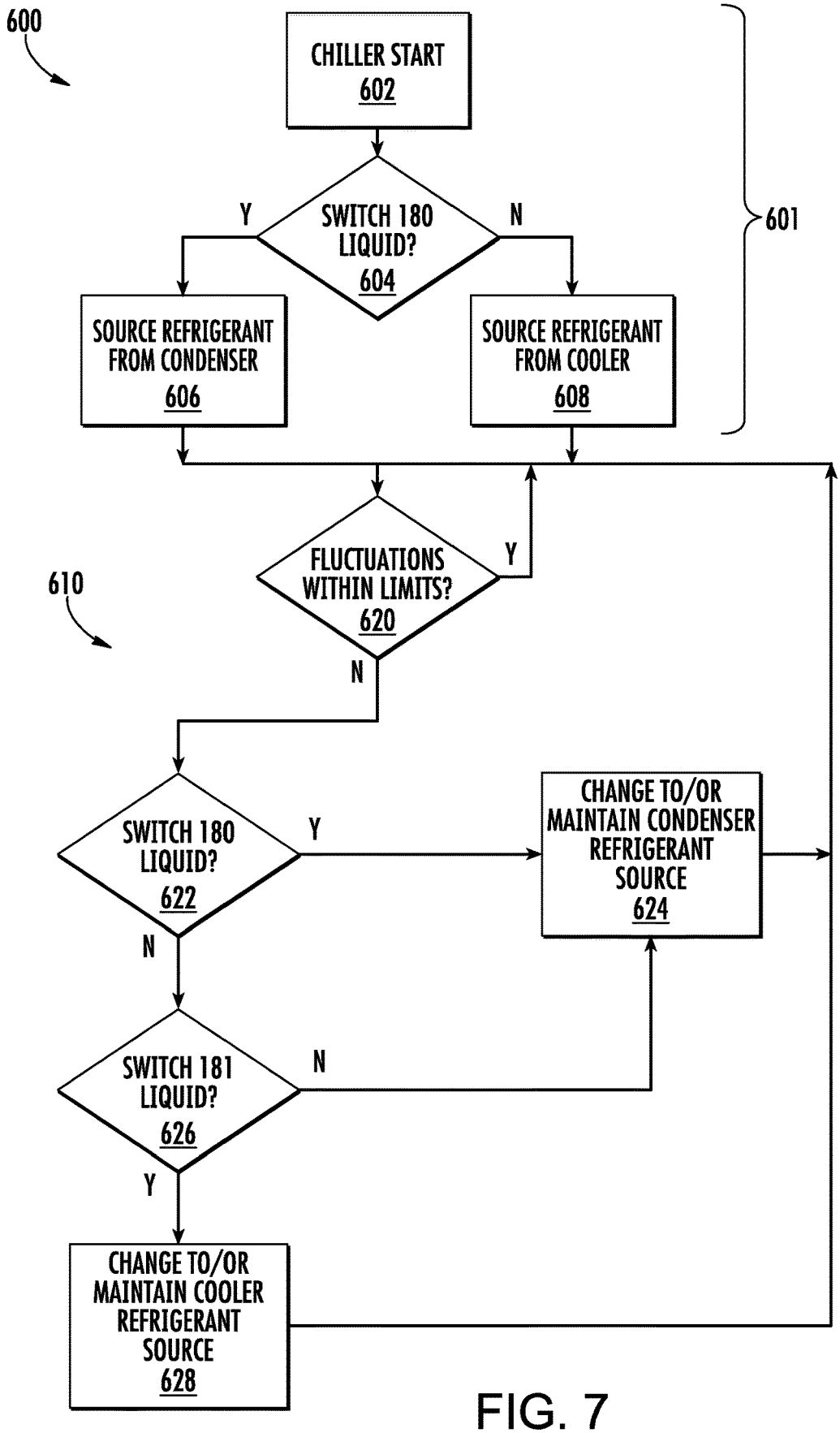
FIG. 7 is a flowchart of a first control sub-routine.

FIG. 7 shows a control routine or sub-routine 600 which may be programmed or otherwise configured into the controller. The routine provides for improved refrigerant delivery and may be superimposed upon the controller's normal programming/routines (not shown, e.g., providing the basic operation of a baseline system to which the foregoing control routine is added). For example, the normal programming/routines may provide for things such as switching between various modes (e.g., heating versus cooling versus different load situations versus defrost, and the like). In a start-up phase 601, the start command 602 may represent user entry or a program decision (e.g., if a need for operation is detected by the controller). An initial detection 604 is made of condenser liquid (e.g., the state of the switch 180 is associated with the presence of sufficient liquid). This effective default is to the condenser because it is a higher pressure source. If there is sufficient liquid in the condenser, the controller begins 606 sourcing refrigerant from the condenser. This may be achieved by opening the valve 186 (if not already open) and closing the valve 187 (if not already closed) and starting the pump 190. If, however, there is insufficient liquid, the controller similarly begins 608 sourcing refrigerant from the cooler. In either event, upon start (and potentially after an initial programmed delay) a loop 610 may be run until shutdown (whereupon the sub-routine may resume at 602). The loop 610 includes an initial determination 620 by the controller of whether fluctuations (e.g., pressure fluctuations from the sensor 192) are within preset limits. One example is to sample pressure at an interval (e.g., one second) over a period (e.g., twenty seconds). The controller may record max. and min. values over the period. If the difference between max and min exceeds a value (e.g., 25% of a calculated average) then fluctuation is deemed excessive. If yes (to excessive fluctuation), the sub-routine loops back to the fluctuation determination 620 without changing sourcing. If no, the output of the switch 180 is revisited 622 to determine sufficient liquid in the condenser.

If yes at 622, then the controller maintains the condenser as the source or changes 624 to the condenser if the cooler had been the source. If no, the state of the switch 181 is used to determine 626 whether there is sufficient liquid in the cooler. If no at 626, then the condenser is changed or maintained to 624 as the source. If yes, the cooler is changed to or maintained as 628 the source. In either event, the loop feeds back to the fluctuation determination 620.

Figure 2:
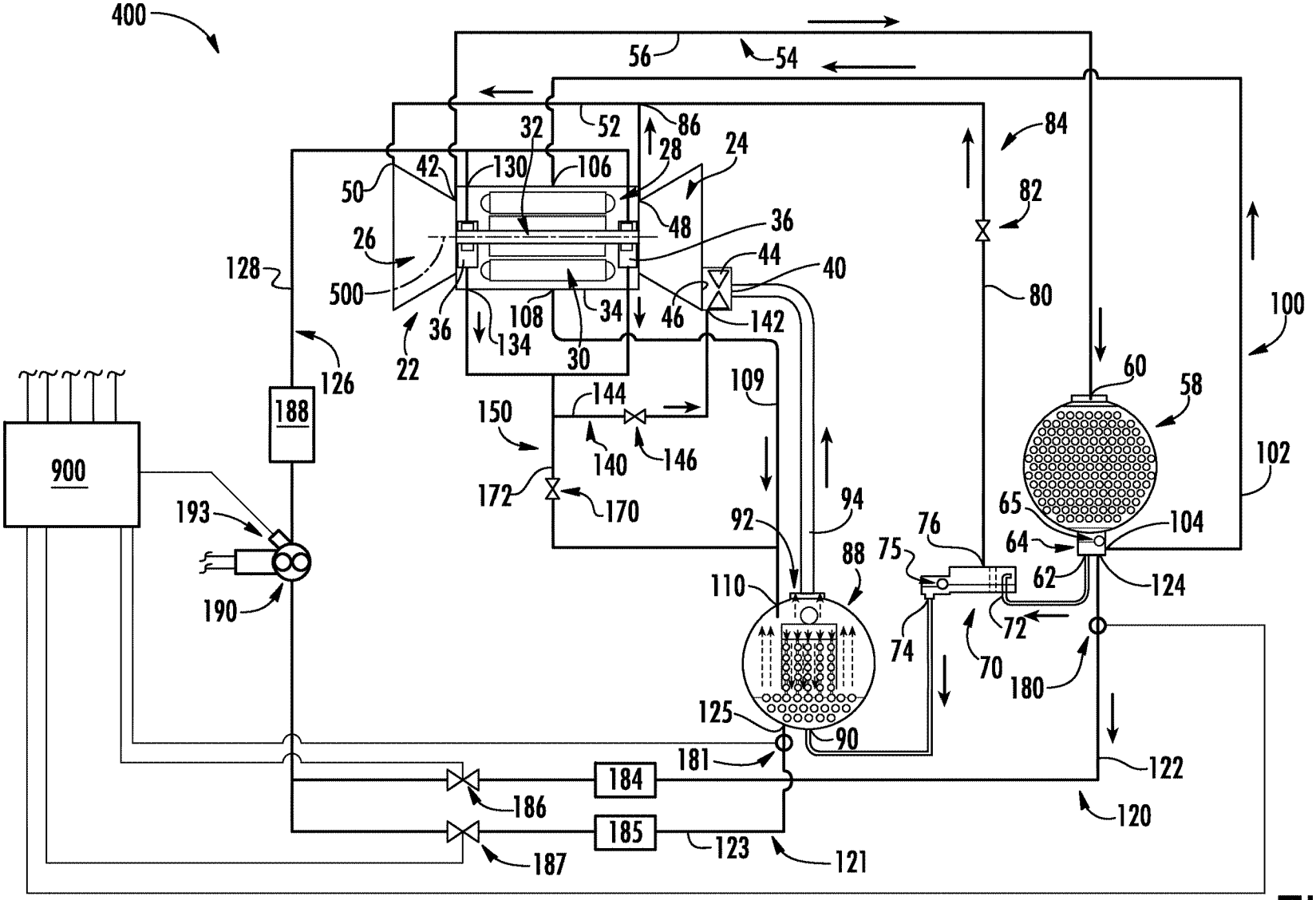
FIG. 2 is a schematic view of a second vapor compression system in a first mode of operation.

FIG. 2 shows one basic variation of a system 400 otherwise similar to the system 20 except that the pressure sensor 192 is replaced by a vibration sensor (e.g., accelerometer such as a piezoelectric accelerometer) 193. The vibration sensor may be located along the line 128 or may be mounted to the housing of the pump 190. Sensed vibration may indicate pump cavitation or vapor ingestion. Accordingly, the controller 900 may use sensed vibration above a threshold in a similar fashion to pressure fluctuations from the pressure sensor 192.

Figure 3:
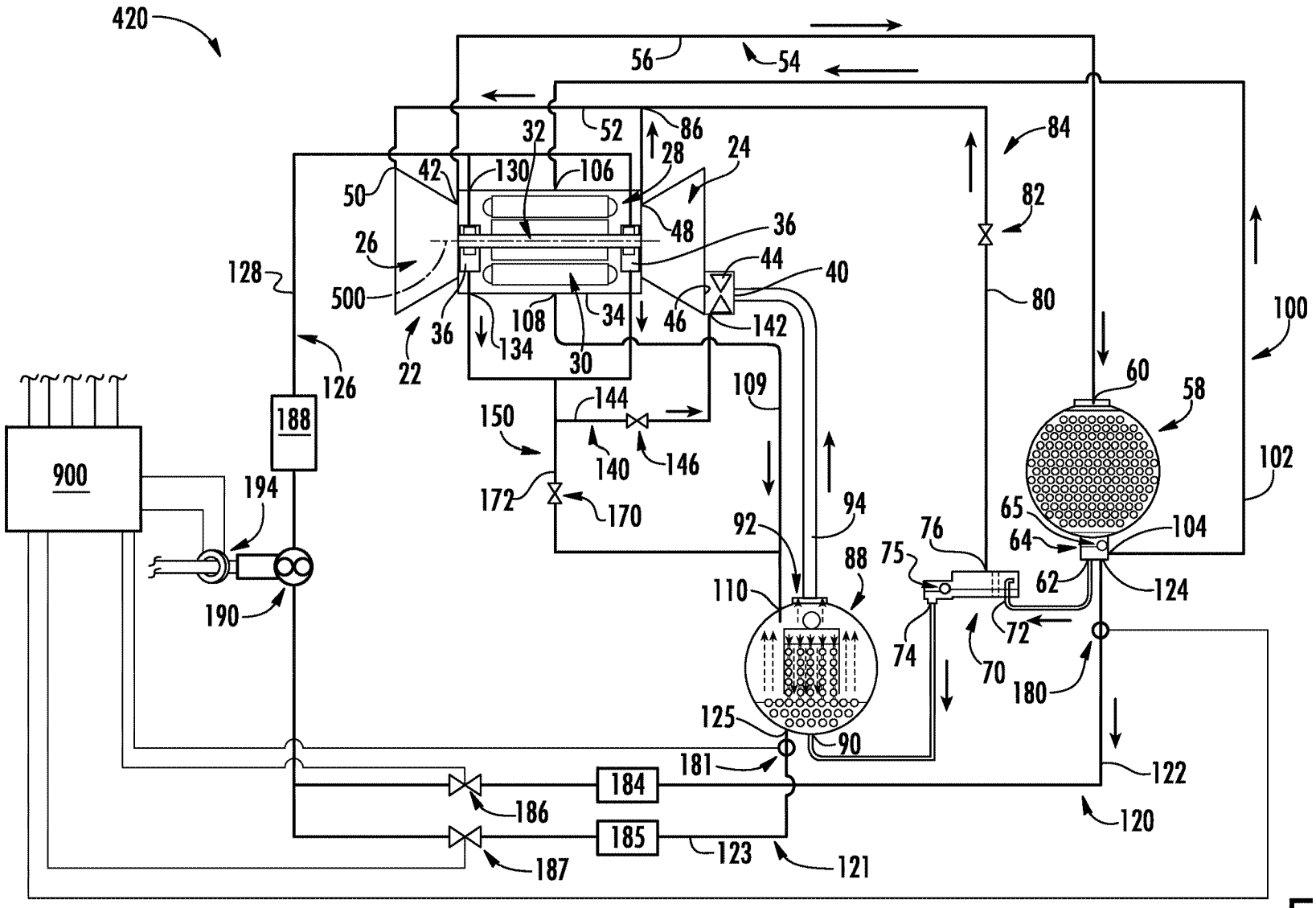
FIG. 3 is schematic view of a third vapor compression system in a first mode of operation.

FIG. 3 shows a further variation of a system 420 otherwise similar to the systems 20 and 400 except that the pressure sensor 192 or vibration sensor 193 are replaced by a motor current sensor 194 (e.g., a loop-type current sensor/current transducer) monitoring current drawn by the electric motor of the pump 190. Current fluctuations above a threshold may be used by the controller 900 in a similar fashion to the aforementioned pressure fluctuations and pump vibrations. As is discussed further below, various embodiments may include multiple such sensors or other sensors and appropriate logic may be used to determine threshold fluctuations based upon the combination of sensors.

Figure 4:
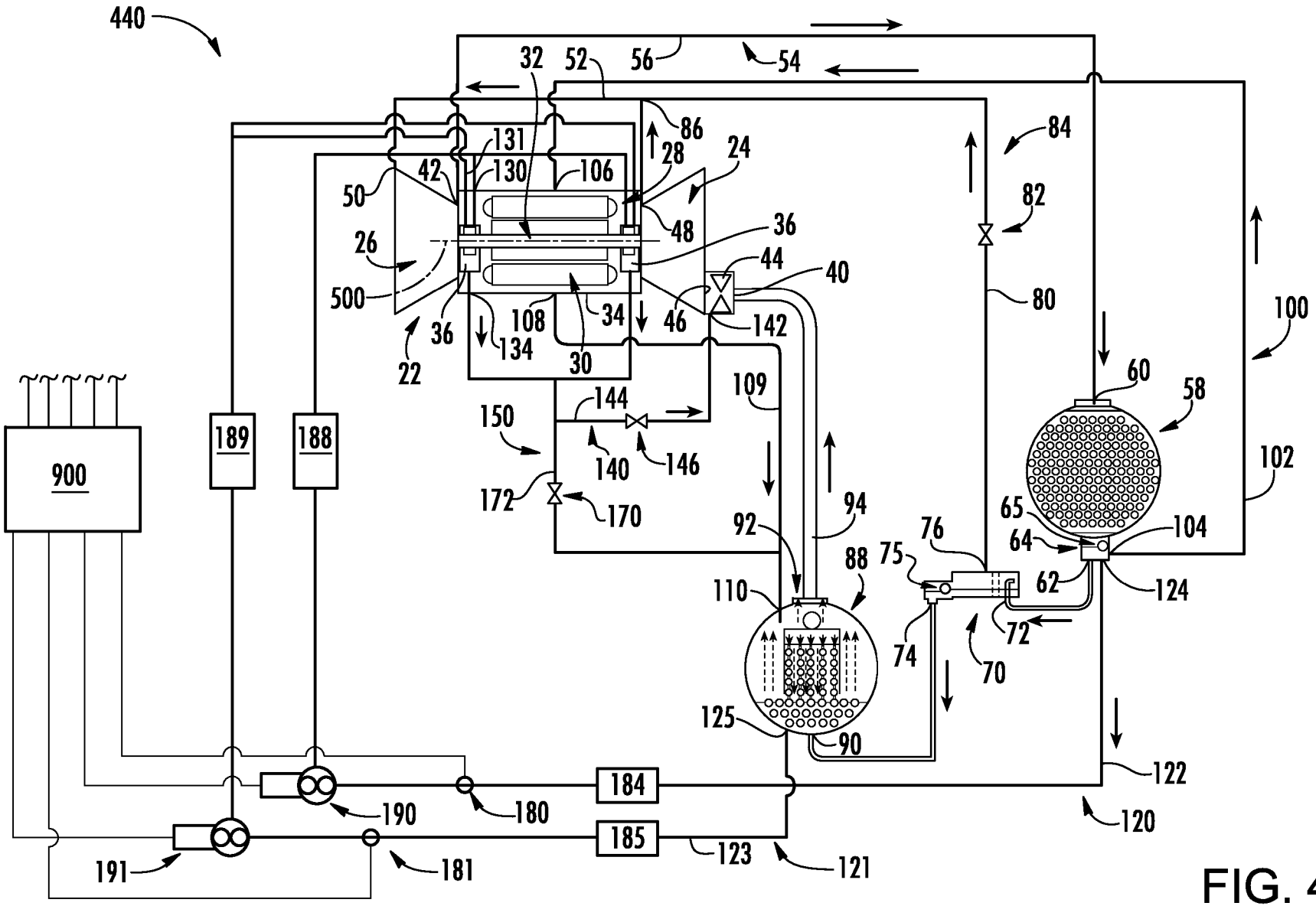
FIG. 4 is schematic view of a fourth vapor compression system in a first mode of operation.

FIG. 4 shows a further variation of a system 440 otherwise similar to the systems above except that two pumps 190, 191 are placed along the respective flowpaths 120, 121 and the respective liquid sensors 180, 181 are shifted to locations immediately upstream of the pumps (e.g., downstream of the strainers 184, 185). As yet further variations, FIG. 4 shows the system 440 having respective filters 188, 189 in the two flowpaths (e.g., rather than having the flowpaths merge to a single filter) and also has the two flowpaths extending all the way separately to associated ports on the housing and associated ports to the bearings.

Figure 8:
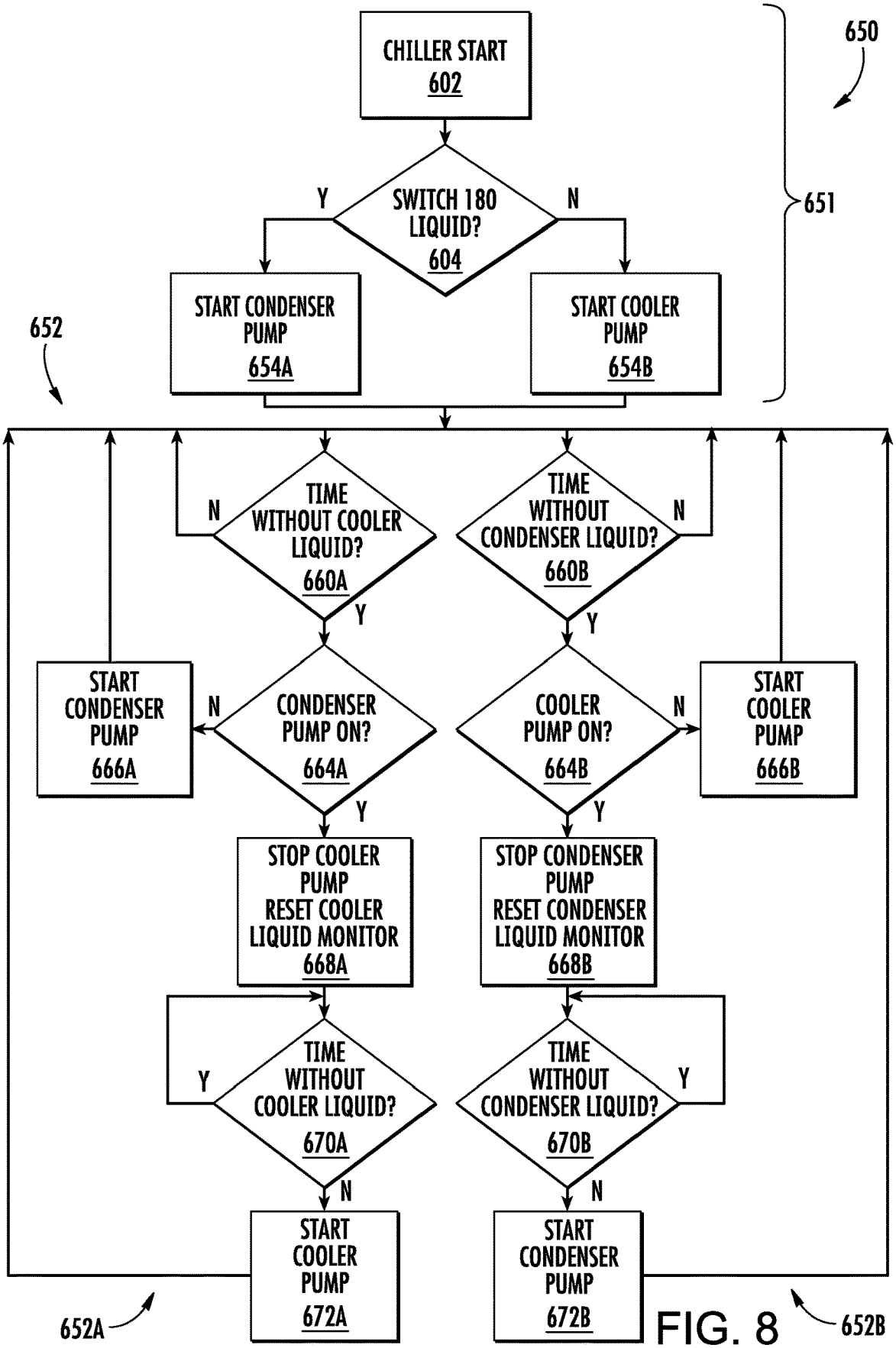
FIG. 8 is a flowchart of a second control sub-routine.

FIG. 8 shows one example of a control sub-routine 650 that starts with a start-up phase 651 representing a slight modification of the start-up phase 601. Because there are respective pumps for the condenser and cooler, the sourcing of refrigerant from these is started by starting 654A, 654B the associated pump. The subsequent loop 652 is actually two separate loops 652A and 652B performed in parallel and having symmetry between cooler and condenser. Queries 660A and 660B respectively involve determination of whether a threshold time has passed (e.g., 15 seconds) with insufficient liquid in the cooler and condenser. As discussed above, the sensors (e.g., switches) 180 and 181 may respectively be used for the condenser and cooler. If the answer to the query 660A, 660B is no, the query recursively repeats. If, however, the answer is yes (the threshold time has passed without sufficient liquid) a subsequent query 664A, 664B involves a determination (or reading a stored data) as to whether the pump associated with the other of the cooler or condenser is on. If the answer to that query is no, then such other pump is started 666A, 666B and the monitor is reset 662A, 662B.

If, however, the pump of the other of the cooler or condenser is on, then the respective cooler or condenser pump (if itself on) is stopped and the associated liquid monitor reset 668A, 668B. It is thus seen that this control scheme contemplates that both pumps might be operating at a given time. Additional variations (not discussed) may create priorities between the two pumps and thus introduce asymmetry to the sub-routine.

Thereafter, a recursive interrogation of the threshold time without liquid for the respective cooler or condenser is performed 670A, 670B (e.g., similar to 660A, 660B). If the answer is no, then the associated cooler pump or condenser pump is started 672A, 672B.

Figure 5:
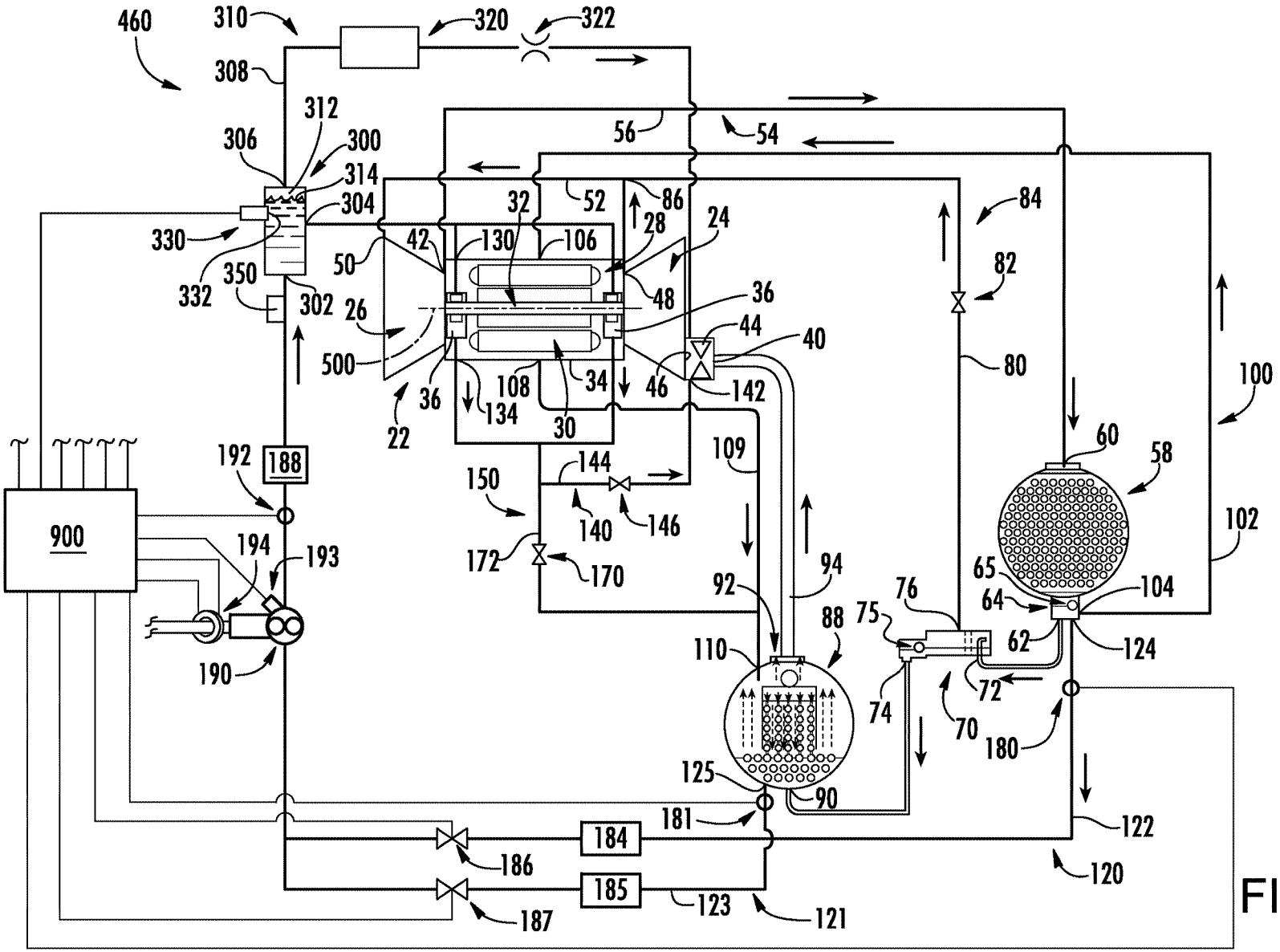
FIG. 5 is schematic view of a fifth vapor compression system in a first mode of operation.
Figure 6:
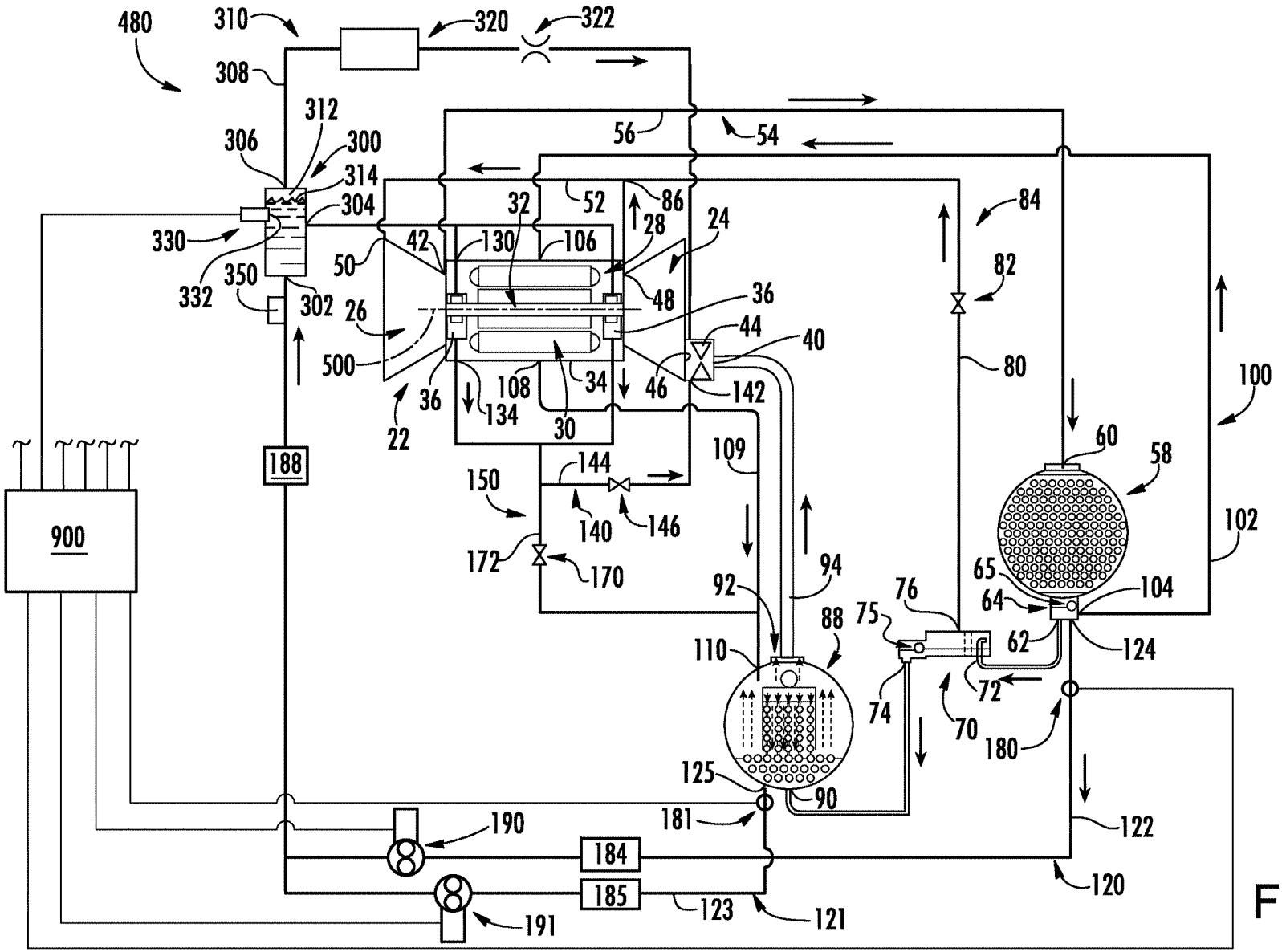
FIG. 6 is a schematic view of a sixth vapor compression system in a first mode of operation.

FIGS. 5 and 6 show further variations of respective systems 460 and 480 but which include a degas tank 300 downstream of the pump(s) along the bearing supply line and flowpath. The two respective variations are a single pump variation and a dual pump variation along the lines of the two variants previously discussed.

The degas tank has an inlet 302 for receiving liquid refrigerant (e.g., downstream of the filter 190). The exemplary inlet 302 is at a bottom of the tank. The exemplary tank is a cylindrical metallic tank oriented with its axis vertically. An exemplary refrigerant outlet 304 is along a sidewall of the tank. An additional port 306 on the tank is connected to a vacuum line 308 and associated flowpath 310 (a branch off the bearing supply flowpath) to draw vapor from the headspace 312 of the tank. The exemplary line 308 and flowpath 310 extend to a low pressure location in the system. An exemplary low pressure location is downstream of the inlet guide vanes such as the port 142, port 246, or a similar dedicated port. Other low pressure locations within the compressor (bypassing the compressor inlet) or along the main flowpath upstream of the compressor inlet may be used. Similarly, the refrigerant supply flowpath may branch off the main flowpath at any of several locations appropriate for the particular system configuration. Along the line 308 and flowpath 310, FIG. 5 also shows an exemplary strainer 320 and orifice 322. The orifice functions to limit flow rate to avoid drawing liquid from the degas tank. FIG. 5 shows a single one of each sensor 192, 193, 194 in common to both refrigerant supplies. Other sensors or less than all three sensors may be utilized in various implementations.

FIG. 5 further shows a liquid level sensor 330 mounted to the tank. The exemplary liquid level sensor 330 is mounted above the ports 302 and 304. An exemplary mounting is by a height of at least 25 mm (or at least 30 mm or 25 mm to 50 mm or 30 mm to 40 mm) above the outlet port 304 (i.e., the central axis 520 of the sensor is spaced by that much above the upper extremity of the outlet port). The sensor may be oriented horizontally (e.g., with the axis of its cylindrical body and its prism) within about 10° or 5° of horizontal) to avoid trapping of bubbles by the sensor. Thus, the line 308 and flowpath 310 withdraw vapor from above the sensor 330. Although these are shown extending from the bearing supply flowpath directly back to the compressor (instead of rejoining the main flowpath upstream of the suction port), other low-pressure destinations might be used.

A number of types and configurations of liquid level sensors exist. The exemplary sensor is an optical sensor as discussed below. The sensor has an operative/sensing end 332 positioned to be exposed to the liquid in a normal situation of sufficient liquid. In this example, the sensor is an optical sensor and the exposure is an optical exposure which may, however, also include physical exposure with the end 332 contacting the fluid (liquid refrigerant and/or vapor) in the tank. The exemplary optical sensor is a solid state relay-type sensor. The sensor 330 may be used to determine whether the liquid surface 314 has descended below a critical level (whereafter further descent might risk vapor passing through the port 304 and being ingested by the bearings). The determination of the surface 314 descending to this threshold height may trigger a response by the controller 900. Exemplary responses may include compressor shutdown or may include some form of remedial activity.

FIGS. 5 and 6 also show a temperature sensor 350 downstream of the filter 188 for measuring temperature of refrigerant entering the compressor for bearing cooling. In various implementations, the combination of the pressure and temperature downstream of the refrigerant filter can be used to calculate the degree to which the refrigerant supply to the bearings is sub-cooled. A small amount of sub-cooling indicates that the refrigerant pump has started to cavitate or that the refrigerant filter is becoming plugged and needs to be replaced.

The FIG. 6 system has respective pumps 190 and 191 along the two flowpaths upstream of a merging to feed a single shared filter 188. The FIG. 6 embodiment also highlights that the FIG. 5 layout need not include any of the sensors 192, 193, 194. However, it also highlights that variations on the FIG. 6 embodiment may have such sensors. Various implementations may locate the sensors 192 and 193 along the individual lines 122 and 123 at or downstream of their merger.

Figure 9:
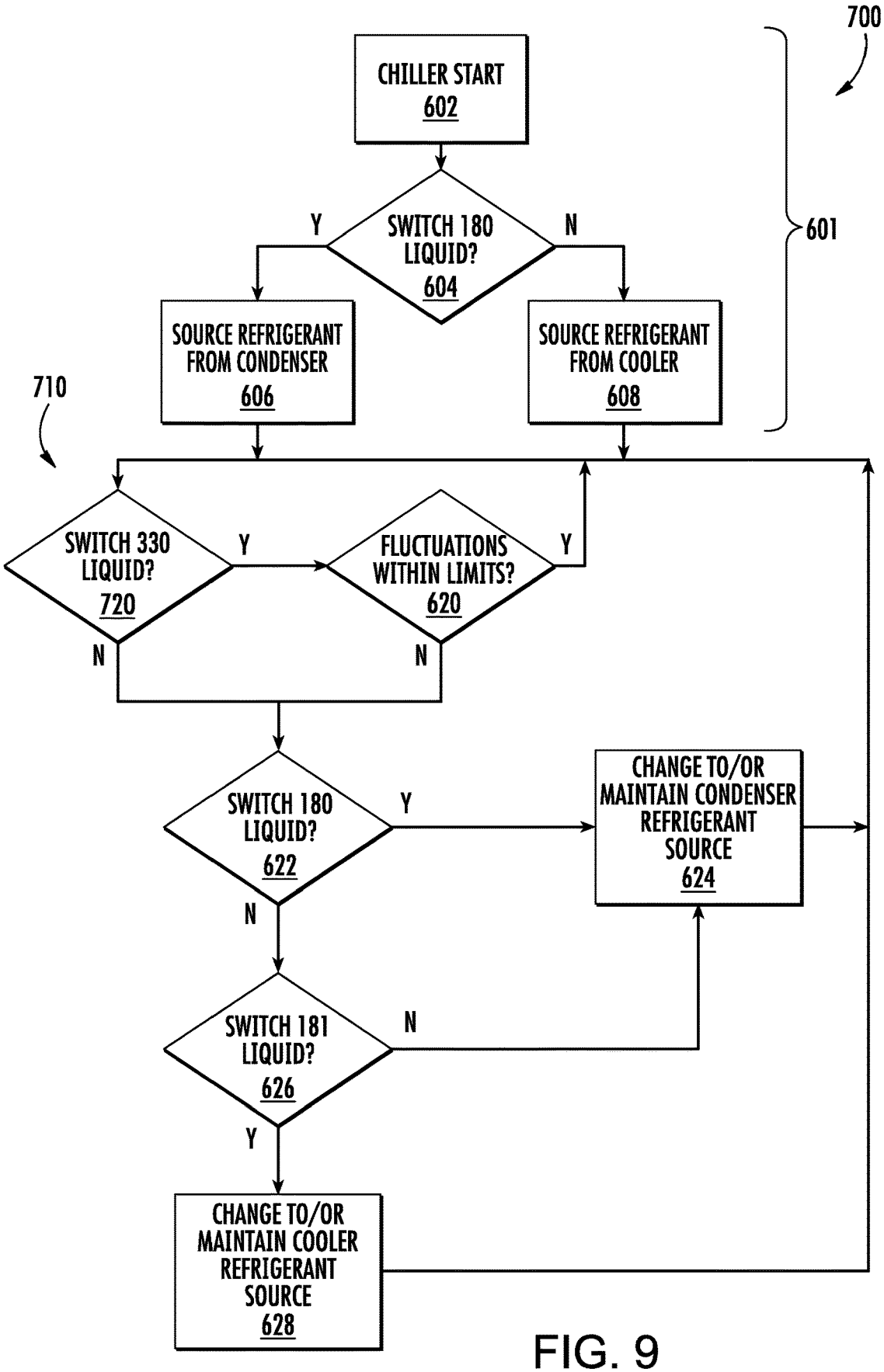
FIG. 9 is a flowchart of a third control sub-routine.
Figure 10:
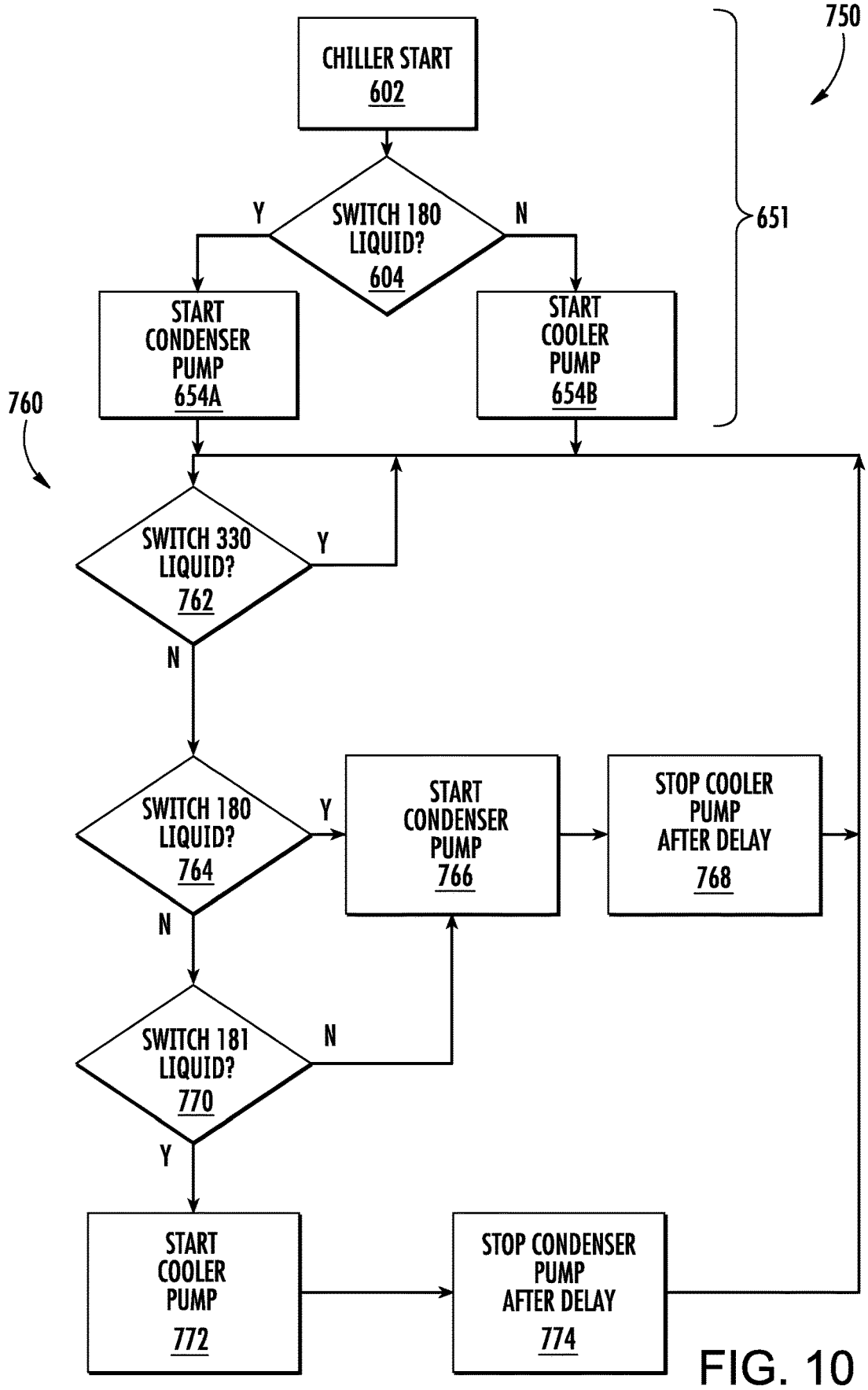
FIG. 10 is a flowchart of a fourth control sub-routine.

Alternative sub-routines for the systems of FIGS. 5 and 6 are respectively shown in FIGS. 9 and 10. FIG. 9 involves a sub-routine 700 nearly identical to the sub-routine 600 but wherein the loop 710 also involves an interrogation 720 of the tank liquid level sensor 330 (switch).

This interrogation 720 is the initial step in the loop 710. If yes (there is sufficient liquid in the tank), then the determination 620 is made as in the sub-routine 600 and the loop 710 proceeds as the loop 610. If no (insufficient liquid in the tank), then the determination 620 is bypassed and the sub-routine 710 proceeds to the determination 622 of condenser liquid of the loop 610.

FIG. 10 is a sub-routine 750 with an altered start-up 651 of FIG. 8. In the loop 760, the initial step 762 is determining sufficiency of liquid in the tank 300 as previously discussed. If yes, then the process repeats. If no, then the sufficiency of the condenser liquid is determined 764. If sufficient condenser liquid is present, then the condenser pump is started (if not already running) 766. If running, the cooler pump is then stopped 768 after a delay (e.g., ten seconds) again returning to the beginning of the loop 760. If insufficient condenser liquid, then the cooler liquid sufficiency is determined 770. If insufficient cooler liquid, then the process loops back to the starting of the condenser pump 766. If there is sufficient cooler liquid, then a cooler pump is started (if not already running) 772 and the condenser pump (if running) is stopped 774 after a similar delay as in 768.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A vapor compression system (20; 400; 420) comprising:

a compressor (22) having a suction port (40) and a discharge port (42);

a heat rejection heat exchanger (58) coupled to the discharge port to receive compressed refrigerant;

a heat absorption heat exchanger (88);

a first lubricant flowpath (120, 126) from the heat rejection heat exchanger to the compressor;

a second lubricant flowpath (121, 126) from the heat absorption heat exchanger to the compressor;

at least one lubricant pump (190);

a controller (900); and one or more valves (186, 187) controlled by the controller to selectively switch lubricant flow between the first lubricant flowpath and the second lubricant flowpath;

wherein:

the controller (900) is configured to control the one or more valves (186, 187) to control lubricant flow along the first lubricant flowpath and the second lubricant flowpath based on a sensed fluctuation.

2. The system of claim 1 wherein:

the at least one lubricant pump is shared by the first lubricant flowpath and the second lubricant flowpath; and the system comprises a pressure sensor (192) positioned to measure an outlet pressure of the at least one lubricant pump.

3. The system of claim 1 wherein:

the sensed fluctuation is a sensed fluctuation in an outlet pressure of the at least one lubricant pump.

4. The system of claim 1 wherein:

the at least one lubricant pump is shared by the first lubricant flowpath and the second lubricant flowpath; and the system comprises a vibration sensor (193) positioned to measure a vibration of the at least one lubricant pump.

5. The system of claim 1 wherein:

the compressor comprises an electric motor (28); and the first lubricant flowpath and the second lubricant flowpath extend to bearings (36) of the motor.

6. The system of claim 1 wherein the one or more valves comprise:

a first valve (186) controlled by the controller along the first lubricant flowpath; and a second valve (187) controlled by the controller along the second lubricant flowpath.

7. The system of claim 1 wherein:

the system is a chiller.

8. A method for using the system of claim 1, the method comprising:

running the at least one lubricant pump to drive a lubricant flow along one of the first lubricant flowpath and the second lubricant flowpath and not the other of the first lubricant flowpath and the second lubricant flowpath; and responsive to the controller sensing a threshold of said fluctuation, the controller switching to running the at least one lubricant pump to drive a lubricant flow along said other of the first lubricant flowpath and the second lubricant flowpath and not said one of the first lubricant flowpath and the second lubricant flowpath.

9. The method of claim 8 further comprising:

after having commenced the running of the at least one lubricant pump, commencing running the compressor to drive a flow of refrigerant sequentially through the heat rejection heat exchanger, an expansion device, and the heat absorption heat exchanger.

10. The method of claim 8 wherein:

the switching comprises controlling at least one valve while continuously running the at least one lubricant pump.

11. A vapor compression system (440; 480) comprising:

a compressor (22) having a suction port (40) and a discharge port (42);

a heat rejection heat exchanger (58) coupled to the discharge port to receive compressed refrigerant;

a heat absorption heat exchanger (88);

a first lubricant flowpath (120, 126) from the heat rejection heat exchanger to the compressor;

a first pump (190) along the first lubricant flowpath;

a second lubricant flowpath (121, 126) from the heat absorption heat exchanger to the compressor;

a second pump (191) along the second lubricant flowpath; and a controller configured to stop the first pump after starting the second pump and stop the second pump after starting the first pump.

12. The system of claim 11 further comprising:

a first liquid level switch (180) associated with the first pump; and a second liquid level switch (181) associated with the second pump.

13. The system of claim 12 wherein the controller (900) is configured to:

responsive to the first liquid level switch indicating low, stop the first pump and start the second pump; and responsive to the second liquid level switch indicating low, stop the second pump and start the first pump.

14. The system of claim 13 wherein:

the first liquid level switch is upstream of the first pump; and the second liquid level switch is upstream of the second pump.

15. A method for using the system of claim 11, the method comprising:

running the first pump to drive a lubricant flow along the first lubricant flowpath; and switching to running the second pump to drive a lubricant flow along the second lubricant flowpath.

16. The method of claim 15 further comprising stopping the first pump after starting the second pump.

17. The method of claim 15 further comprising:

after having commenced the running of at least one of the first pump and the second pump, commencing running the compressor to drive a flow of refrigerant sequentially through the heat rejection heat exchanger, an expansion device, and the heat absorption heat exchanger.

18. A vapor compression system (20; 400; 420) comprising:

a compressor (22) having a suction port (40) and a discharge port (42);

a heat rejection heat exchanger (58) coupled to the discharge port to receive compressed refrigerant;

a heat absorption heat exchanger (88);

a first lubricant flowpath (120, 126) from the heat rejection heat exchanger to the compressor;

a second lubricant flowpath (121, 126) from the heat absorption heat exchanger to the compressor;

at least one lubricant pump (190); and a controller (900) configured to control lubricant flow along the first lubricant flowpath and the second lubricant flowpath based on a sensed fluctuation, the sensed fluctuation being a sensed vibration of the at least one lubricant pump or a sensed current drawn by an electric motor of the at least one lubricant pump.

19. The system of claim 18 wherein:

the controller (900) is configured to control the at least one lubricant pump or, if present, one or more valves to control the lubricant flow along the first lubricant flowpath and the second lubricant flowpath based on output of the sensed fluctuation.

20. The system of claim 18 further comprising:

one or more valves to control the lubricant flow along the first lubricant flowpath and the second lubricant flowpath, wherein:

the controller (900) is configured to control the at least one lubricant pump or the one or more valves to control the lubricant flow along the first lubricant flowpath and the second lubricant flowpath based on output of the sensed fluctuation.

* * * * *